US006547558B2

(12) United States Patent
McCall

(10) Patent No.: US 6,547,558 B2
(45) Date of Patent: Apr. 15, 2003

(54) METHODS OF MAKING A FUEL-FIRED HEATING APPLIANCE

(75) Inventor: Shannon H. McCall, Montgomery, AL (US)

(73) Assignee: The Water Heater Industry Joint Research and Development Consortium, Rio Verde, AZ (US)

( * ) Notice: Subject to any disclaimer, the term of this patent is extended or adjusted under 35 U.S.C. 154(b) by 0 days.

(21) Appl. No.: 10/090,217

(22) Filed: Mar. 4, 2002

(65) Prior Publication Data

US 2002/0170502 A1 Nov. 21, 2002

Related U.S. Application Data

(62) Division of application No. 09/855,306, filed on May 15, 2001.

(51) Int. Cl.[7] ..... F27D 1/18

(52) U.S. Cl. ..... 432/250; 73/323; 73/326; 29/890.052

(58) Field of Search ..... 432/237, 250; 122/19.2, 494, 498; 110/173 R; 73/323, 326; 52/598; 396/647; 29/890.03, 890.051, 890.052

(56) References Cited

U.S. PATENT DOCUMENTS

| | | | | |
|---|---|---|---|---|
| 4,526,444 A | | 7/1985 | Fantone et al. | 350/501 |
| 5,628,231 A | * | 5/1997 | Sheridan | 73/323 |
| 6,079,403 A | * | 6/2000 | Binder | 126/190 |
| 6,230,665 B1 | * | 5/2001 | Reynolds et al. | 122/13.01 |
| 6,269,779 B2 | * | 8/2001 | Overbey, Jr. | 122/13.01 |

* cited by examiner

*Primary Examiner*—Gregory Wilson
(74) *Attorney, Agent, or Firm*—Konneker & Smith, P.C.

(57) ABSTRACT

An inner combustion chamber access door member for a fuel-fired water heater has main and pilot burner structures respectively supported thereon by gas supply tubes sealingly extending through and anchored to the door member, and is further provided with a wire pass-through tube and a sight glass opening. After the door member has been externally secured to a side wall portion of the water heater over an access opening therein, with the main and pilot burner structures disposed in the combustion chamber of the water heater, a lighting wand is extended through the sight glass opening to light and test the burners. Subsequently, a sight glass structure is snapped into the sight glass opening to complete the installation of the door/burner assembly. Thermocouple and igniter wires extend through the pass-through tube, and are sealed therein by a laterally split resilient cylindrical sealing plug member.

10 Claims, 6 Drawing Sheets

METHODS OF MAKING A FUEL-FIRED HEATING APPLIANCE

CROSS-REFERENCE TO RELATED APPLICATION

This application is a division of copending U.S. application Ser. No. 09/855,306 filed on May 15, 2001 and entitled "INNER DOOR/BURNER ASSEMBLY FOR FUEL-FIRED WATER HEATER".

BACKGROUND OF THE INVENTION

The present invention generally relates to fuel-fired heating appliances and, in a preferred embodiment thereof, more particularly provides a specially designed inner door/burner assembly for a gas-fired water heater.

As conventionally constructed, a gas-fired water heater has a combustion chamber opening outwardly through a side wall access opening and having disposed therein main and pilot burner assemblies respectively supplied with gas via main and pilot gas supply tubes connected to the burner assemblies and extending outwardly through the side wall access opening. When the water heater is initially fabricated, the in-place main and pilot gas burners in the combustion chamber are lit and tested by passing a lighting wand inwardly through the side wall access opening into the combustion chamber and lighting the burners. If the burner test is successful, an inner access door is then placed over the side wall access opening, with slots in the door receiving the previously installed gas supply tubes extending into the combustion chamber through the side wall access opening.

This well known conventional assembly and testing method has several limitations and disadvantages. For example, because the inner access door is separate from the main and pilot gas supply tubes, it is difficult to form an adequate seal between the inner access door being installed and the previously installed main and pilot gas supply tubes. Additionally, several separate steps are required in installing the door, the burners and the gas supply tubes, thereby undesirably adding to the complexity and overall cost of fabricating the water heater.

In view of the foregoing it can readily be seen that a need exists for an improved inner door construction for a fuel-fired water heater that eliminates or at least substantially reduces the above-mentioned limitations and disadvantages associated with conventional inner door constructions and associated door installation techniques. It is to this need that the present invention is primarily directed.

SUMMARY OF THE INVENTION

In carrying out principles of the present invention, in accordance with a preferred embodiment thereof, a specially designed access door/burner assembly is provided for use with a fuel-fired heating appliance, representatively a gas-fired water heater, having a combustion chamber opening outwardly through a side wall access opening in the appliance.

The access door/burner assembly comprises an access door member securable to the heating appliance over the side wall access opening, the door member having a burner test lighting opening therein. A sight glass structure is snap-fittable into the burner test lighting opening, and a fuel supply tube structure, including main and pilot fuel supply tubes, is anchored to and sealingly extends through the access door member. A burner structure is operatively secured to the fuel supply tube structure and is movable into and out of the combustion chamber in respective response to placement of the access door member on the side wall of the heating appliance and removal of the access door member from the side wall portion of the heating appliance. Representatively, the burner test lighting opening in the access door member has a peripheral notch therein, and the sight glass structure has a resilient tab portion snap-fitted into the notch.

The unique configuration of the access door/burner assembly facilitates the installation thereof on the heating appliance, and also facilitates the initial lighting and testing of the appliance's burner structure. In carrying out a method of the present invention, the access door member, with its burner lighting and testing opening uncovered, is moved toward the appliance's access opening, to operatively place the burner structure within the combustion chamber, and then suitable secured to the appliance side wall portion. A lighting structure, such as a conventional lighting wand, is then inserted through the access wall opening and used to light and test the burner structure within the combustion chamber. After the burner lighting and testing procedure is completed, and the lighting structure withdrawn from the combustion chamber, the sight glass structure is snapped into place within the previously open burner lighting and testing opening in the installed access door member.

The special configuration of the access door/burner assembly substantially simplifies the installation of both the burner structure and the access door portions of the heating appliance, and at the same time provides for a simple and easy lighting and testing of the burner structure within the combustion chamber.

According to another feature of the present invention, a pass-through tube is extended through and anchored to the access door member, and a plurality of wires, illustratively thermocouple and igniter wires, are sealingly extended through the pass-through tube utilizing a specially designed resilient plug member.

In a preferred embodiment thereof, the resilient plug member has a tapered cylindrical configuration and is radially split into first and second halves which are foldable about a peripheral flap portion of the plug member between an open position in which flat sides of the plug halves extend in opposite directions from the peripheral flap portion, and a closed position in which the flat sides face and abut one another. The flat sides of the plug halves have recesses therein which are configured to receive side portions of the thermocouple and igniter wires. Alternatively, the plug may be configured to (1) sealingly receive the pilot fuel supply tube—either by itself or in addition to either or both of the thermocouple and igniter wires, or (2) sealingly receive either of the thermocouple and igniter wires by itself.

The wires are sealingly extended through the pass-through tube by placing side portions of the wires in associated ones of the side recesses with the sealing plug member in its open position and then folding the plug member to its closed position. The closed sealing plug member is then coaxially placed and radially wedged into the pass-through tube. One or more of the wires may be fixedly secured to the sealing plug member if desired.

While principles of the present invention are representatively incorporated in a gas-fired water heater, it will be readily appreciated by one of skill in this particular art that such principles may alternatively be utilized to advantage in a variety of other types of fuel-fired heating appliances such as, for example, fuel-fired boilers and air heating furnaces.

DETAILED DESCRIPTION

Figure 1:
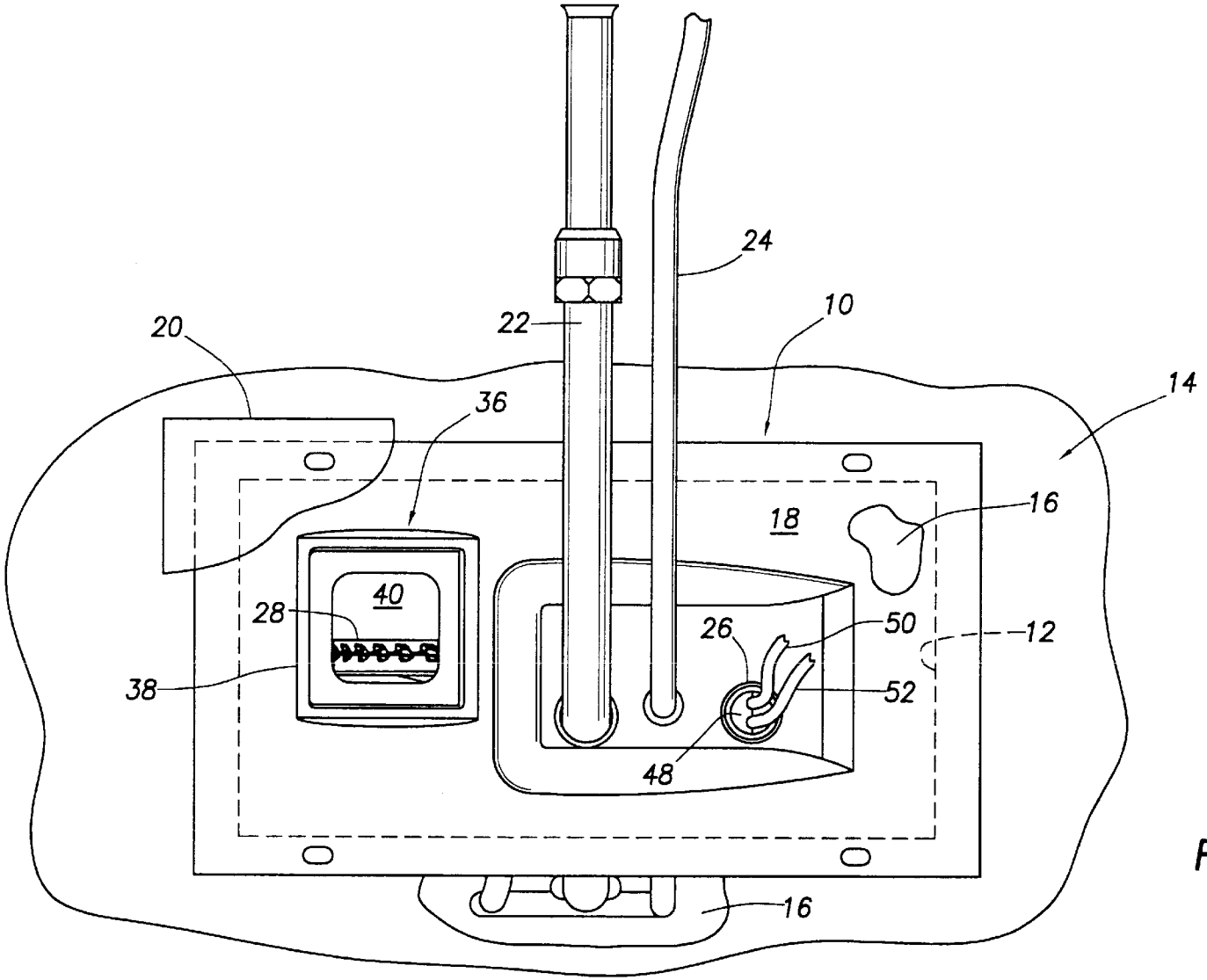
FIG. 1 is a partially cut away side elevational view of a bottom end portion of a gas-fired water heater having incorporated therein a specially designed inner door/burner assembly embodying principles of the present invention.
Figure 2:
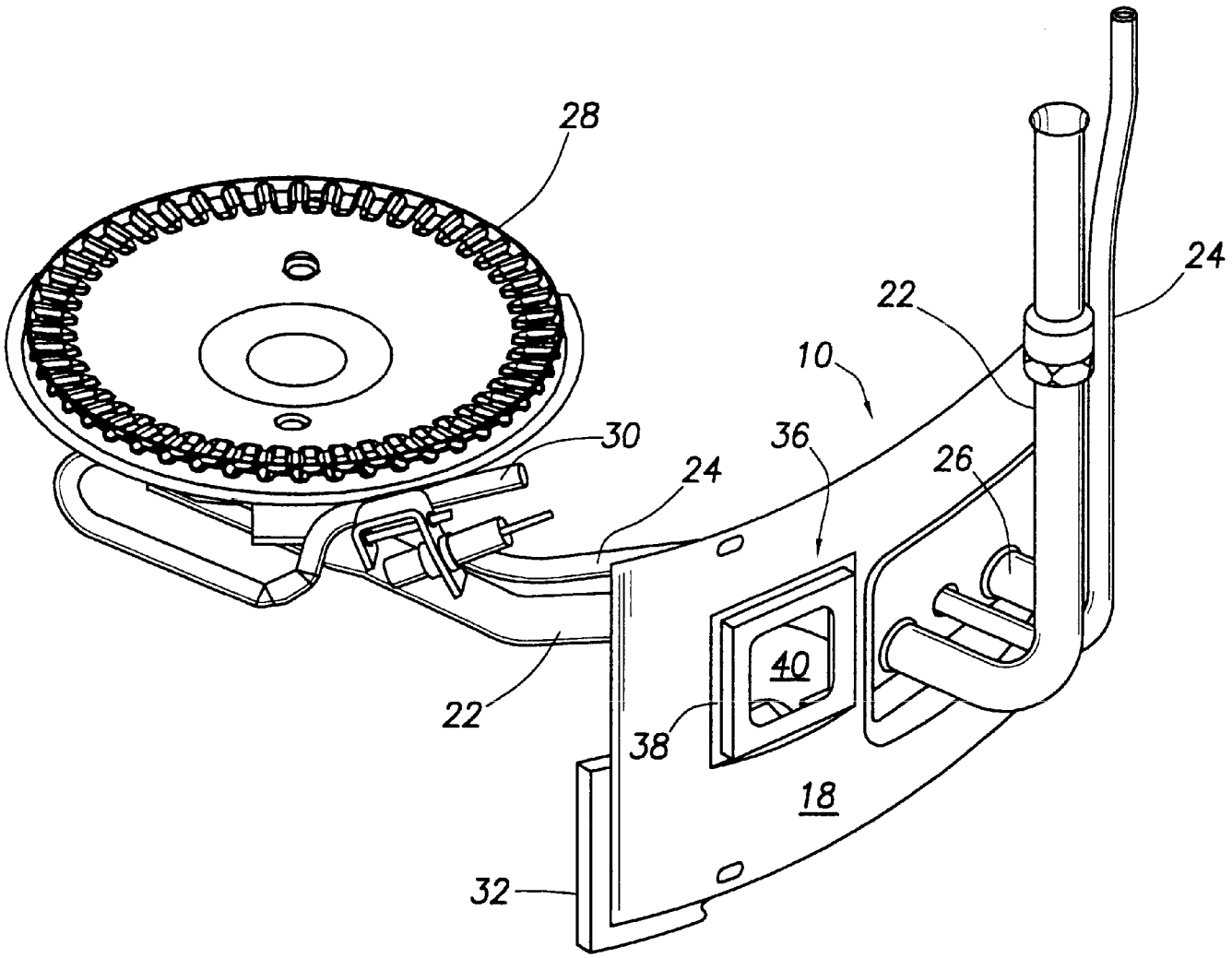
FIG. 2 is a front side perspective view of the inner door/burner assembly.

As illustrated in FIGS. 1–3A, this invention provides a specially designed inner door structure 10 that is securable over an outer sidewall access opening 12 (see FIG. 1) disposed in a lower end portion of a gas-fired water heater 14, the opening 12 extending into the combustion chamber 16 within the water heater 14. Inner door structure 10 includes a curved rectangular inner door member 18 that underlies a cosmetic outer door member 20 (a corner portion of which is shown in FIG. 1) and is removably secured to the outer side of the water heater 14.

Sealingly extending through corresponding openings in the door member 18, and anchored thereto, are a main gas supply tube 22, a pilot gas supply tube 24, and a pass-through tube 26. The inner end of the main gas supply tube 22 is operatively secured to a main burner 28 disposed within the combustion chamber 16, and the inner end of the pilot gas supply tube 24 is operatively secured to a pilot burner structure 30 also disposed within the combustion chamber 16.

In the assembly and initial testing of a conventional water heater of this general type, the gas supply tubes 22,24 are not secured to an access door, but are extended inwardly through the sidewall opening 12 into the combustion chamber 16 prior to the installation of an inner access door over the opening 12. The burners 28,30 are then tested by passing a lighting wand inwardly through the opening 12 to verify that the pilot and main burners light correctly. A separate inner access door is then installed over the previously installed tubes 22,24.

This prior art assembly method carries with it several well known limitations and disadvantages. For example, because the inner access door is separate from the tubes 22,24 it is difficult to form an adequate seal between the inner access door being installed and the previously installed tubes 22,24. Additionally, several separate steps are required in installing the door, the burners and the tubes 22,24, thereby undesirably adding to the complexity and cost of fabricating the water heater.

Due to a special configuration of the inner door structure 10 of the present invention, several advantages are provided compared to this prior approach. First, as previously mentioned, the gas supply tubes 22,24 are sealingly anchored to the door member 18 so that the tube 22 and 24, the burners 28 and 30, and the door member 18 are movable as a unit. This permits the door member 18 to be connected to the outer sidewall of the water heater 14 after the main and pilot burners 28,30 supported by the door member 18 are inserted into the combustion chamber 16. In other words, the inner access door 18, the gas supply tubes 22,24 and the burners 28,30 may be operatively associated with the balance of the water heater 14 in a single step. Coupled with the sealing engagement of the tubes 22,24 with the door member 18, a suitable sealing gasket 32 (see FIG. 2) disposed on the inner side of the door member 18 automatically provides a complete, efficient seal between the installed door member 18 and the outer side of the water heater 14 in response to securement of the inner access door member 18 to the water heater 14 over its side wall access opening 12. when the door member 18 is removed from the water heater 10, the burners 28,30 are simultaneously removed from the combustion chamber 16.

Second, a rectangular sight glass/burner test lighting opening 34 (see FIG. 3) extends through the door member 18. After the door member 18 is installed on the outer side wall of the water heater 14, a burner lighting structure such as the schematically depicted lighting wand 35 may be inserted inwardly through the door member opening 34 into the combustion chamber 16 (as indicated by the arrow 35*a* in FIG. 3) to test light the main and pilot burners 28 and 30. After the burner test is successfully completed through the sight glass opening 34, a specially designed snap-in sight glass assembly 36 (see FIGS. 1, 2, 3A and 4) is snapped into the opening 34.

Figure 3:
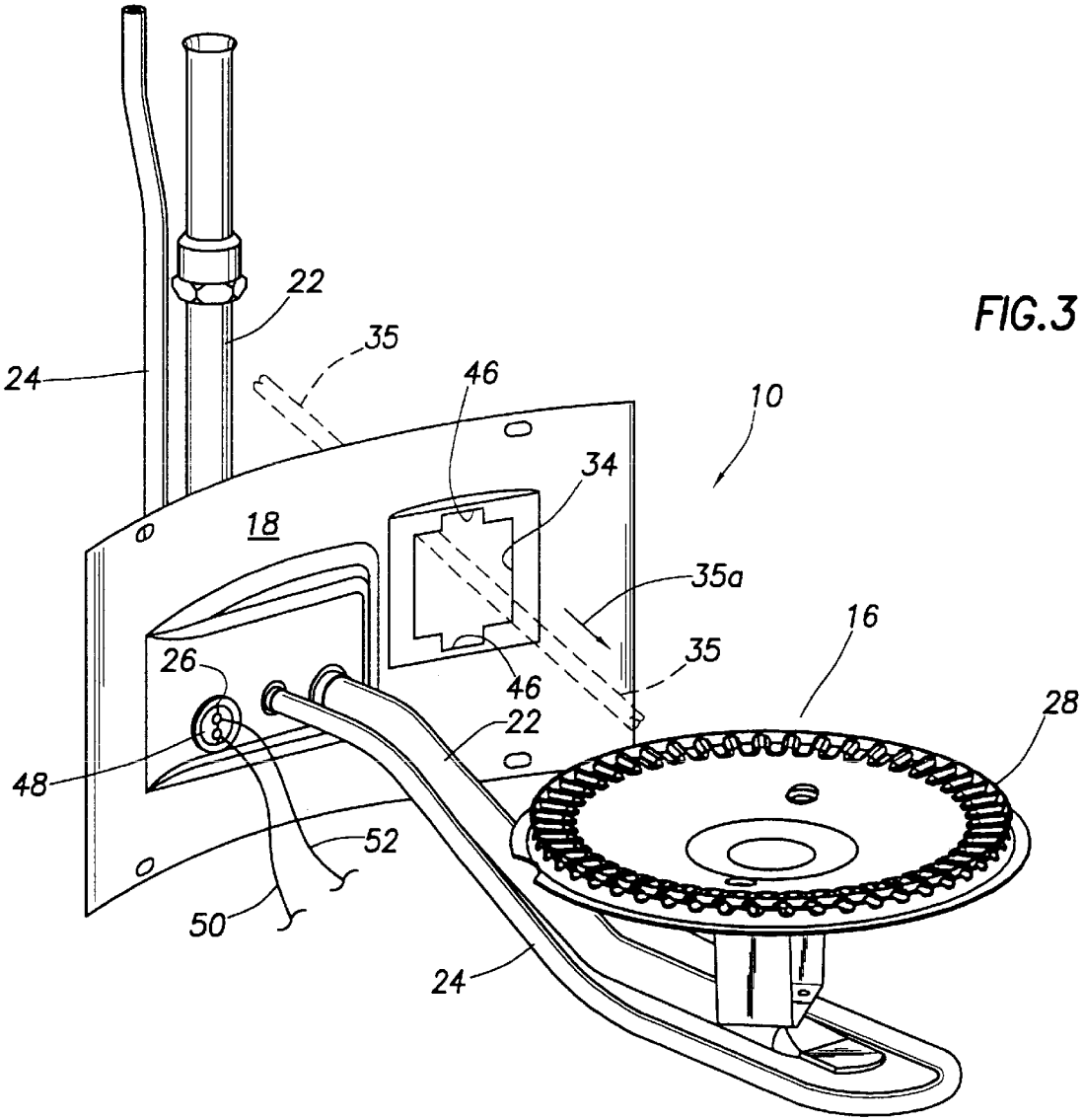
FIG. 3 is a rear side perspective view of the inner door/burner assembly prior to a specially designed snap-in sight glass structure being installed in the access door member portion thereof, and illustrates an improved burner lighting and testing method facilitated by the assembly.
Figure 3A:
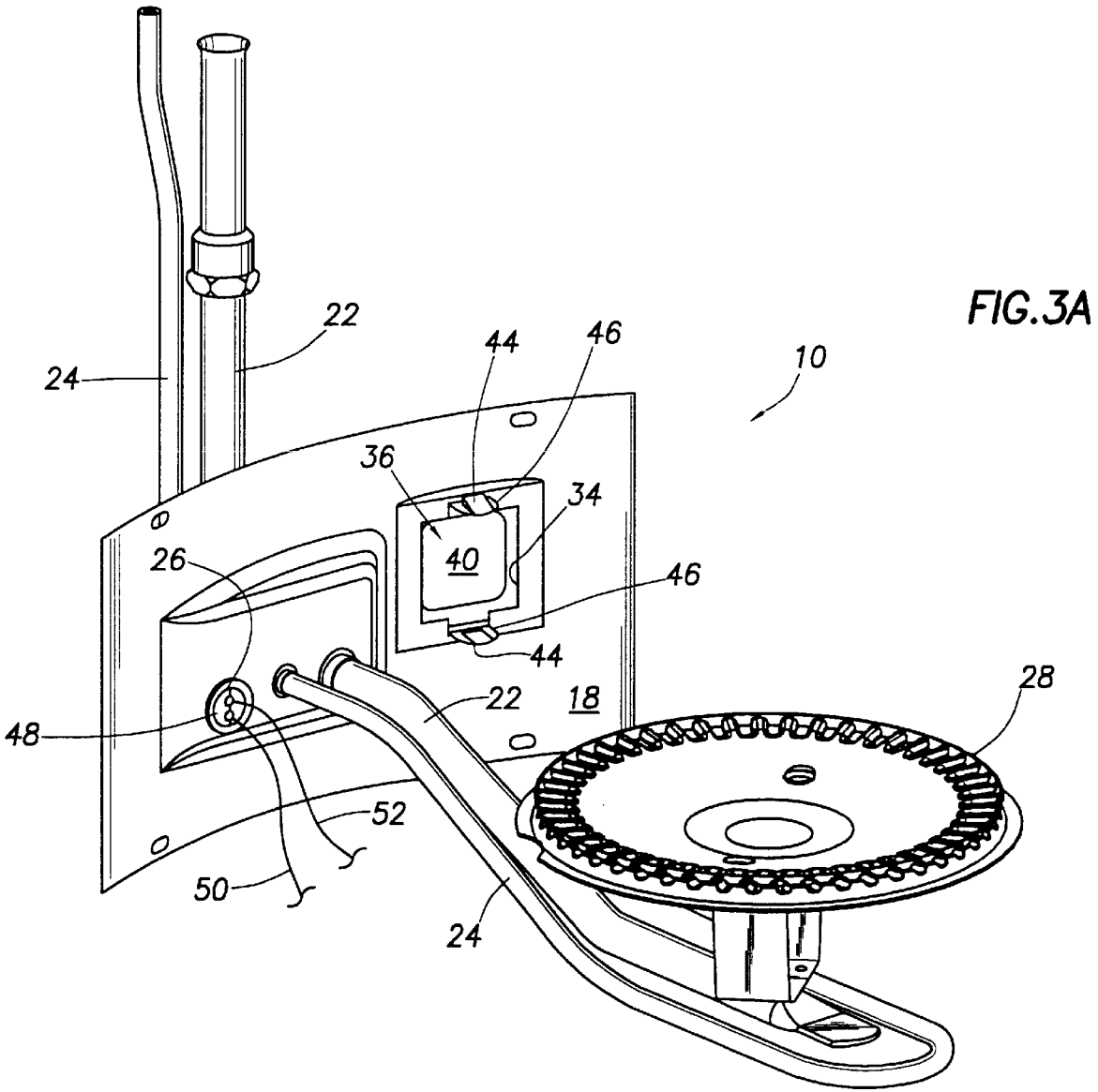
FIG. 3A is a view similar to that in FIG. 3 but with the snap-in sight glass structure being installed in the inner access door member portion of the assembly after the burner lighting and testing method has been completed.
Figure 4:
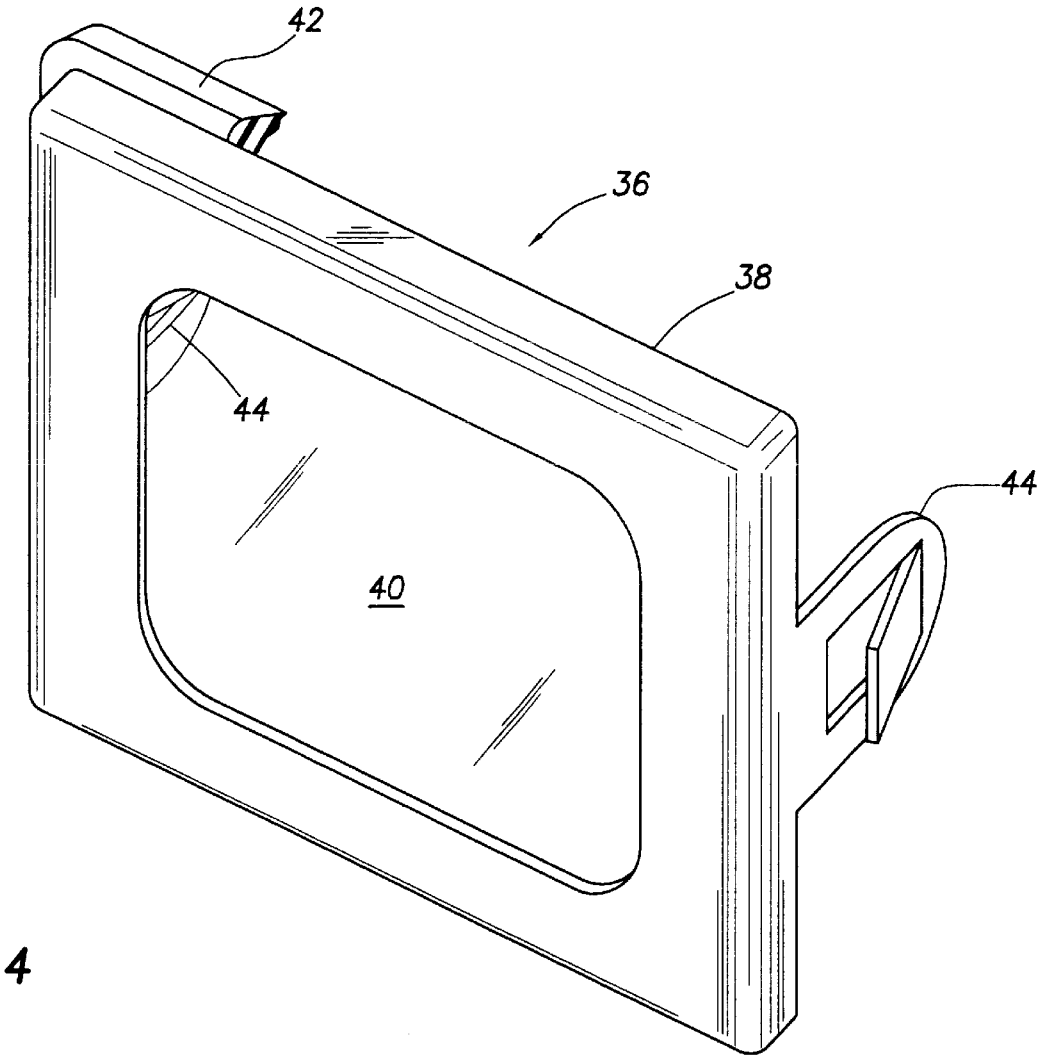
FIG. 4 is an enlarged scale front side perspective view of the snap-in sight glass structure.

As best illustrated in FIG. 4, the sight glass assembly 36 includes a rectangular metal frame 38 that surrounds a sight glass pane 40 and has a suitable sealing gasket 42 on its inner side. Extending rearwardly from the rear or inner side of the frame 38 are a pair of snap tab structures 44 which are inserted into and lockingly received in corresponding notches 46 (see FIGS. 3 and 3A) in the periphery of the sight glass opening 34 after the burners 28,30 have been lit and tested.

Figure 9:
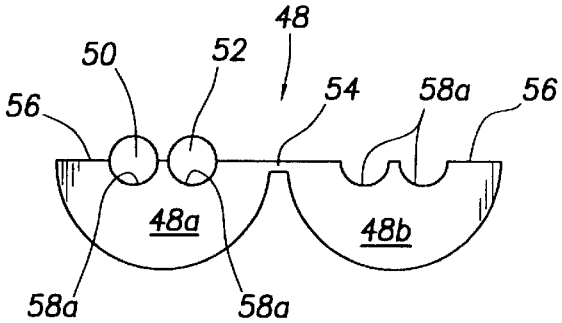
FIG. 9 is an end view of the sealing plug member in an open orientation with the thermocouple and igniter wires ready to be sealingly secured in the plug member after it has been laterally folded to its closed orientation.
Figure 8:
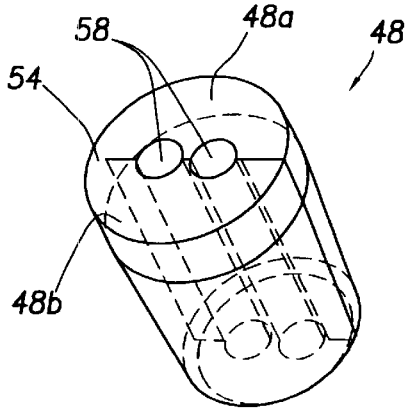
FIG. 8 is a perspective view of the sealing plug member without the thermocouple and igniter wires disposed therein.
Figure 6:
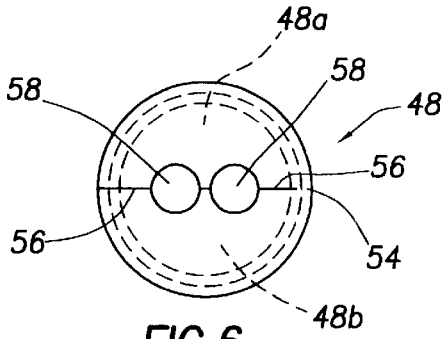
FIGS. 6 and 7, respectively, are end and side elevational views of the sealing plug member in its closed orientation without the thermocouple and igniter wires disposed therein.
Figure 7:
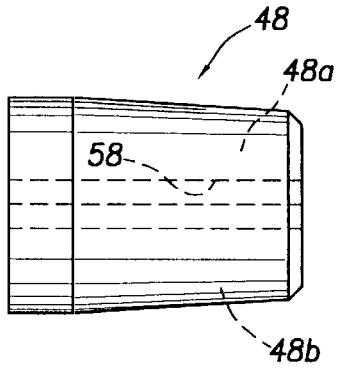
Figure 5:
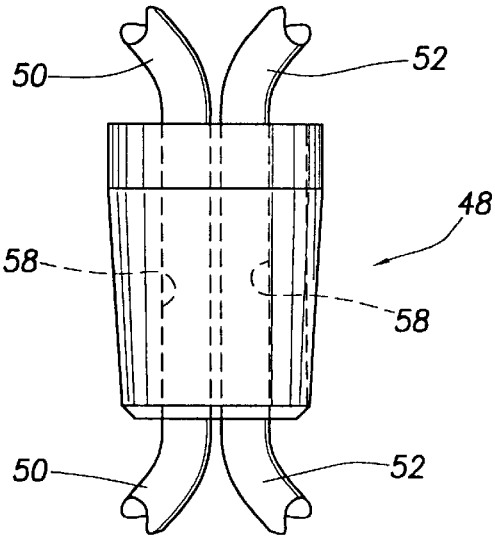
FIG. 5 is a side view of a laterally split resilient sealing plug member incorporated in the door member portion of the inner door/burner assembly, the plug member being shown in its closed orientation and receiving thermocouple and igniter wire portions of the inner door/burner assembly.

Third, a laterally split resilient cylindrical sealing plug 48 (see FIGS. 1, 3 and 5–9) is positioned around thermocouple and igniter wires 50,52 as indicated, and sealingly wedged within the feed-through tube 26 (through which the wires 50,52 extend to the pilot burner structure 30 in the combustion chamber 16) to provide an efficient seal between these wires and the door member 18. Sealing plug 48 may be molded on, or otherwise anchored to, at least one of the wires 50,52 as shown in FIG. 9. This retains the plug 48 with the wires 50,52, thereby preventing loss of the plug 48 and facilitating operative positioning of the plug 48 and the wires 50,52 within the pass-through tube 26.

Turning now to FIGS. 5–9, the sealing plug 48 is of a tapered, generally cylindrical configuration in which laterally split halves 48*a*,48*b* of the plug 48 are joined together by a peripheral flap 54. The plug halves 48*a*,48*b* may be folded about the flap 54 between an open position (see FIG.

9) in which flat sides 56 of the halves 48*a*,48*b* extend in opposite directions from the flap 54, and a closed position (see FIG. 6) in which the halves 48*a*,48*b* extend in the same direction from the flap 54 and face one another.

The flat sides 56 of the sealing plug halves 48*a*,48*b* (see FIG. 9) have semicircular grooves 58*a* that form in the closed plug member 48 circularly cross-sectioned, longitudinally extending openings 58 which sealingly grip the thermocouple and igniter wires 48,50 when the closed plug member 48 is axially forced into and sealingly wedged within the pass-through tube 26 (see FIGS. 1 and 3). The laterally split, foldable configuration of the sealing plug 48 facilitates the placement of the wires 48,50 therein, while the tapered cylindrical shape of the closed sealing plug 48 facilitates its operative placement in, and its subsequent removal from, the pass-through tube 26.

The sealing plug 48 can be alternatively configured, if desired, to (1) sealingly receive the pilot tube 24 (instead of the pilot tube 24 being sealingly extended directly through the inner door member 18 as shown)—either by itself or in addition to either or both of the thermocouple and igniter wires 28 and 50, or (2) sealingly receive either of the thermocouple and igniter wires 28,30 by itself.

As can readily be seen from the foregoing, the provision of the specially designed inner door/burner assembly 10 substantially simplifies the installation of the door member 18 and the associated gas burners 28 and 30 and the gas supply tubes 22 and 24, while at the same time providing for easy lighting and testing of the burners (via the incorporation of the unique snap-in sight glass structure 36 installed after the door 18 has been mounted and the burner lighting and testing procedure completed), and automatically provides reliable sealing between the door 18 and the gas supply tubes 22,24 and the wires 50,52.

While principles of the present invention have been representatively illustrated and described as being incorporated in a fuel-fired water heater, it will be readily appreciated by those of skill in this particular art that such principles could alternatively be advantageously employed in a variety of other types of fuel-fired heating appliances such as, for example, boilers and air heating furnaces.

The foregoing detailed description is to be clearly understood as being given by way of illustration and example only, the spirit and scope of the present invention being limited solely by the appended claims.

What is claimed is:

1. A method of fabricating and testing a fuel-fired heating appliance having a side wall portion with an opening therein, and a combustion chamber opening outwardly through said opening, said method comprising the steps of:

providing an access door/burner assembly including an access door member having a burner lighting and test opening therein, main and pilot fuel supply tubes sealingly extending through and anchored to said access door member, and main and pilot fuel burners supported on said main and pilot fuel supply tubes for movement with said access door member;

positioning said main and pilot fuel burners within said combustion chamber;

installing said access door member on said side wall portion to cover said side wall portion opening;

inserting a lighting structure into said combustion chamber through said burner lighting and test opening in the installed access door member;

using the inserted lighting structure to light and test said main and pilot fuel burners;

withdrawing the inserted lighting structure from said combustion chamber through said burner lighting and test opening; and snap-fitting a sight glass structure into said burner lighting and testing opening after said withdrawing step.

2. The method of claim 1 wherein:

said fuel-fired heating appliance has a thermocouple wire and an igniter wire, said access door member has a pass-through tube extending therethrough, and said method further comprises the step of sealingly extending at least one of said pilot fuel supply tube, said thermocouple wire and said igniter wire through said pass-through tube.

3. The method of claim 2 wherein said expending step is performed by:

providing a resilient sealing plug member, extending said at least one of said pilot fuel supply tube, said thermocouple wire and said igniter wire axially through an interior portion of said resilient sealing plug member, and placing and wedging said resilient sealing plug member within said pass-through tube.

4. The method of claim 3 further comprising the step of:

fixedly securing said sealing plug member to at least one of said thermocouple wire and said igniter wires.

5. A fuel-fired heating appliance fabricated and tested by the method of claim 4.

6. The method of claim 3 wherein:

said providing step is performed by providing a tapered cylindrical resilient plug member having a radially split configuration in which first and second halves of said plug member are foldable about a peripheral flap portion of said plug member between an open position in which flat sides of said first and second halves extend in opposite directions from said peripheral flap portion, and a closed position in which said flat sides face and abut one another, said flat sides having recesses therein which are configured to receive side portions of said at least one of said pilot fuel supply tube, said thermocouple wire and said igniter wire, said extending step is performed by placing side portions of said at least one of said pilot fuel supply tube, said thermocouple wire and said igniter wire in associated ones of said recesses with said sealing plug member in said open position, and then folding said sealing plug member to said closed position, and said coaxially placing and radially wedging step is performed with said plug member in said closed position.

7. A fuel-fired heating appliance fabricated and tested by the method of claim 6.

8. A fuel-fired heating appliance fabricated and tested by the method of claim 3.

9. A fuel-fired heating appliance fabricated and tested by the method of claim 2.

10. A fuel-fired heating appliance fabricated and tested by the method of claim 1.

* * * * *

UNITED STATES PATENT AND TRADEMARK OFFICE

CERTIFICATE OF CORRECTION

PATENT NO. : 6,547,558 B2
DATED : April 15, 2003
INVENTOR(S) : Shannon H. McCall It is certified that error appears in the above-identified patent and that said Letters Patent is hereby corrected as shown below:

Column 6,
Line 19, change "expending" to -- extending --.

Signed and Sealed this

Fifteenth Day of July, 2003

JAMES E. ROGAN
*Director of the United States Patent and Trademark Office*